US012364306B2

(12) United States Patent
Thompsett et al.

(10) Patent No.: US 12,364,306 B2
(45) Date of Patent: Jul. 22, 2025

(54) WOVEN SHOE UPPER WITH POCKETS AND FILLINGS

(71) Applicant: adidas AG, Herzogenaurach (DE)

(72) Inventors: Benjamin Alexander Thompsett, Nuremberg (DE); Matthias Etzold, Herzogenaurach (DE); Quentin Ferrari, Erlangen (DE); Thomas Pitts, Nuremberg (DE); Faina Chunhan Liang, Nuremberg (DE); Adam John Maher, Nuremberg (DE); Brieuc Pierre Marie Ferron, Rome (IT)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/356,073

(22) Filed: Jun. 23, 2021

(65) Prior Publication Data

US 2021/0401106 A1 Dec. 30, 2021

(30) Foreign Application Priority Data

Jun. 24, 2020 (DE) ..... 10 2020 207 848.3

(51) Int. Cl.

| | |
|---|---|
| ***A43B 1/05*** | (2022.01) |
| ***A43B 1/028*** | (2022.01) |
| ***A43B 23/02*** | (2006.01) |

(52) U.S. Cl.

CPC ..... *A43B 1/05* (2022.01); *A43B 1/028* (2022.01); *A43B 23/024* (2013.01); *A43B 23/0265* (2013.01)

(58) Field of Classification Search

None

See application file for complete search history.

(56) References Cited

U.S. PATENT DOCUMENTS

| | | | | |
|---|---|---|---|---|
| 4,232,458 | A * | 11/1980 | Bartels | A43B 7/06 139/413 |
| 4,393,605 | A * | 7/1983 | Spreng | A43B 23/027 36/102 |
| 2005/0081402 | A1* | 4/2005 | Orei | A43B 1/04 36/45 |
| 2005/0208860 | A1* | 9/2005 | Baron | D04H 3/00 442/374 |
| 2006/0112594 | A1* | 6/2006 | Kilgore | B29D 35/146 156/73.1 |
| 2012/0246973 | A1* | 10/2012 | Dua | A43B 23/0255 36/83 |

(Continued)

FOREIGN PATENT DOCUMENTS

| | | | |
|---|---|---|---|
| CN | 104963078 | A | 10/2015 |
| CN | 204763687 | U | 11/2015 |

(Continued)

*Primary Examiner* — Megan E Lynch

(74) *Attorney, Agent, or Firm* — Sterne, Kessler, Goldstein & Fox P.L.L.C.

(57) ABSTRACT

An upper for a shoe includes a woven element comprising at least one single-layer portion and at least one multi-layer portion, wherein the single-layer portion is formed from a single woven layer and the multi-layer portion is formed from at least two overlapping woven layers, wherein the at least one single-layer portion is adjacent to the at least one multi-layer portion, and wherein the multi-layer portion comprises at least one protrusion of the woven element.

23 Claims, 6 Drawing Sheets

(56) References Cited

U.S. PATENT DOCUMENTS

| | | | | |
|---|---|---|---|---|
| 2013/0047467 | A1* | 2/2013 | Roether | A43B 23/04 36/84 |
| 2013/0055590 | A1* | 3/2013 | Mokos | A43B 23/0265 36/45 |
| 2013/0086726 | A1* | 4/2013 | Patercsak | D03D 11/02 139/383 R |
| 2014/0173932 | A1 | 6/2014 | Bell | |
| 2014/0338222 | A1* | 11/2014 | Song | A43B 23/042 12/146 C |
| 2015/0237948 | A1* | 8/2015 | Mallen | A43B 1/04 66/170 |
| 2016/0047072 | A1* | 2/2016 | Tsai | D03D 3/08 139/410 |
| 2016/0326673 | A1* | 11/2016 | Reguillon | D03D 15/50 |
| 2017/0251762 | A1* | 9/2017 | Gu | A43B 23/0275 |
| 2019/0037967 | A1* | 2/2019 | McFarland, II | D04B 1/123 |
| 2020/0046078 | A1 | 2/2020 | Durrell et al. | |
| 2020/0121019 | A1* | 4/2020 | Bartys | A43B 1/04 |
| 2020/0196707 | A1* | 6/2020 | Toronjo | B32B 37/12 |
| 2020/0354866 | A1* | 11/2020 | Danby | D04B 1/16 |

FOREIGN PATENT DOCUMENTS

| | | | | | |
|---|---|---|---|---|---|
| CN | 105286169 | A | | 2/2016 | |
| CN | 105310165 | A | | 2/2016 | |
| CN | 109881331 | A | | 6/2019 | |
| CN | 110804792 | A | | 2/2020 | |
| DE | 627878 | C | | 7/1936 | |
| DE | 102015116398 | A1 | | 3/2017 | |
| GB | 2133273 | A | * | 7/1984 | A41D 31/02 |
| JP | 2012-512698 | A | | 6/2012 | |
| JP | 2017-531475 | A | | 10/2017 | |
| WO | WO-2018189494 | A1 | * | 10/2018 | A43B 1/04 |

* cited by examiner

WOVEN SHOE UPPER WITH POCKETS AND FILLINGS

TECHNICAL FIELD

Embodiments of the present invention relate to an upper for a shoe and a method of manufacturing an upper for a shoe.

BACKGROUND

An article of footwear has to meet several requirements. One of the most important aspects is to ensure a comfortable wearing. The shoe must not only adapt well to an individual foot shape, but also support the wearer as well as possible. The use of woven shoe uppers ensures flexible adaptation to a given foot shape. However, pure woven uppers do not provide good support for the wearer, so the risk of injury is increased.

Furthermore, textiles could be very fragile to external influences depending on the yarn composition and textile structure of the textiles. The contact of the surface of the upper with hard objects causes a quick abrasion, which dramatically shortens the durability of the shoe. Additionally, the breathability of the material and the associated foot climate have a key influence on the wearing comfort of the shoe. To increase the subjective wearing comfort of a wearer and to effectively remove moisture from the foot, good air circulation inside the shoe must be ensured.

US 20130086726A1 is related to woven articles of apparel and methods for making woven items of apparel.

SUMMARY OF THE INVENTION

An object of the present disclosure is therefore to provide a woven upper for a shoe with a long durability of the outer surface of the upper and a good foot climate at the same time. In some embodiments, the above mentioned problems are solved by an upper for a shoe, comprising: a woven element comprising at least one single-layer portion and at least one multi-layer portion, wherein the single-layer portion is formed from a single woven layer and the multi-layer portion is formed from at least two overlapping woven layers, wherein the at least one single-layer portion is adjacent to the at least one multi-layer portion, and wherein the multi-layer portion comprises at least one protrusion of the woven element.

The woven element may comprise a shape essentially corresponding to the shape of the shoe upper. The finished shoe upper may be woven in a single weaving process, which is advantageous for manufacturing simplicity and cost- and time-saving. Furthermore, the number of seams, which may potentially cause blisters and abrasions, can be greatly reduced. Alternatively, the woven element may form merely a part of the shoe upper, i.e. the shoe upper may further comprise other elements such as a knit element, a leather element or any other fabric elements.

The woven element may comprise an outer surface and an inner surface. The at least one protrusion of the woven element may protrude from the outer surface, from the inner surface, or from both the outer and the inner surfaces. Particularly, one of the at least two overlapping woven layers of the multi-layer portion is at the outer surface, and the other woven layer is at the inner surface. At least one of the at least two overlapping woven layers protrudes from the respective outer or inner surface to form the protrusion of the woven element.

The at least one protrusion of the woven element forms a 3D construction on the surface of the shoe upper, which makes a localized structure with elevations that allow an increased air circulation or protection on the surface of the shoe upper. If the protrusion protrudes from the inner surface of the shoe upper, which contacts a wearer's foot while wearing, the air circulation and thus the foot climate inside the shoe can be improved, in particular during heavy physical activity. If the protrusion protrudes from the outer surface of the shoe upper, the 3D structure can provide a better protection at the outermost surface of the shoe upper from hard objects. Therefore, a better abrasion resistance and longer durability of the shoe upper can be provided.

The at least one protrusion of the multi-layer portion may comprise a perimeter not connected to an edge of the shoe upper. Particularly, the protrusion comprises a closed perimeter which forms a closed boundary of the protrusion. Accordingly, an internal space between the at least two overlapping woven layers of the protrusion is closed. A simultaneous sealing of the closed protrusion during the manufacturing process provides a fast manufacturing, as it shortens the production time and avoids subsequent production steps to perform the sealing.

The at least one protrusion of the multi-layer portion may comprise a perimeter ending at an edge of the shoe upper. Particularly, the protrusion comprises an open perimeter and accordingly an open space between the at least two overlapping woven layers of the protrusion. The open protrusion may be sealed after the manufacturing process of the woven element or the shoe upper, which is advantageous and more convenient if filling material is to be added into the protrusion. It is easier to fill an open protrusion as compared to a closed protrusion of the multi-layer portion, because for the latter a post-production step of injection would be needed. Furthermore, it is also easier to integrate additional reinforcement material inside the protrusion for more stability of the structure of the multi-layer portion.

The multi-layer portion may comprise filling material between the at least two overlapping woven layers. In particular, the filling material may be in the internal space of the at least one protrusion of the multi-layer portion. The filling material may create a further stabilization of the protrusion of the woven element. In addition, depending on the composition of the filling material, the filling material may provide a significant influence on the storage of heat and the displacement of humidity inside the shoe. On the outer surface of the shoe upper, the filling material may provide a cushioning effect, which is especially advantageous when being integrated with the abrasion resistance effect provided by the protrusion of the woven element.

In one embodiment, the filling material may be yarns comprising polyester yarns and/or thermoplastic polyurethane (TPU) yarns. The usage of polyester material has several advantages such as high resistance to weather conditions and mechanical stress. Alternatively, the filling material may be recycled yarns, polypropylene yarns, wool yarns, thermoplastic elastomer (TPE) shock absorbing yarns, woven fabric scrap, or any other suitable material to achieve different functional and aesthetical demands. For example, the color and other visual properties of the filling materials can be adjusted and applied in different areas of the shoe upper.

Between the at least two overlapping woven layers of the multi-layer portion, a gap may be formed as from about 1 mm to about 12 mm. At the protrusion of the woven element, the gap may also be understood as a height of the protrusion.

A protrusion with such a height may provide the advantageous effects mentioned herein.

The at least one protrusion of the woven element may comprise a shape of a straight stripe, a curved stripe, or a closed shape. Depending on the varied requirements and demands, different shapes can support and provide the advantageous effects mentioned herein. Furthermore, the shape may be adapted to the requirements in specific areas of the upper.

In one embodiment, the protrusion may comprise a closed shape which has an outer perimeter adjacent to a first single-layer portion and an inner perimeter adjacent to a second single-layer portion. This configuration of the protrusion is particularly advantageous in the instep area of the shoe upper, as the elevations caused by the protrusions prevent the laces from tangling. Particularly, the protrusions used on a u-throat area of the shoe upper can avoid the undesirable lace-pinch effect, which creates excess pressure on a wearer's foot when the laces pinch the skin of the foot.

The closed shape of the protrusion may be a shape of a ring, an arrowhead, or a three-pointed star. Using the techniques described herein, it is possible to provide an upper with protrusions of such involved geometries which would otherwise require more effort and costs.

The multi-layer portion of the woven element may be arranged in at least one of a toe area, a vamp area, a midfoot area, a tongue area, and a heel area of the shoe upper. In addition, the multi-layer portion of the woven element may also be arranged in a collar padding area or an inner lining area of the shoe upper.

The woven element may comprise at least two multi-layer portions which are not connected to each other, and optionally, are arranged at different areas of the shoe upper. The distribution of the multi-layer portions on the shoe upper may result from special design and demands of a shoe for different sports and performance applications, and accordingly optimize the air circulation around or inside the whole shoe.

The woven element may comprise at least two protrusions which differ in at least their shape and/or dimension. The combination of different shapes allows the woven element to meet different requirements at the same time. For example, in some areas of the upper, bulkier protrusions are needed, whereas in other areas, flatter protrusions are needed.

The woven element may comprise a plurality of protrusions, wherein the size of the protrusions increases from the toe area to the heel area of the shoe upper. This configuration provides an adaptation of the size of the protrusions to certain areas of the shoe.

The woven element may comprise a plurality of protrusions, wherein a protrusion closest to the heel area of the shoe upper comprises a largest size. The heel area of a shoe often needs the most cushioning effect and protection function. Using the techniques described herein, such protection may easily be provided by arranging suitable cushioning protrusions in the heel area.

It should be understood that the amount, distribution, and dimension of the plurality of protrusions of the woven element are not limited and may be designed and chosen based on different demands of the shoe upper.

The woven element may comprise a first zone and a second zone which differ in at least the yarns used therein and/or the woven structures thereof. The woven element may comprise polyester yarns and/or TPU yarns and/or nylon yarns, wherein the first zone and the second zone differ in the yarn compositions thereof. The usage of different yarns and/or yarn compositions allows certain areas of the upper to have a higher stretchability than other areas, which enables an improved and optimized fit of the shoe.

The first zone and the second zone may differ in the linear density of the yarns used therein. The combination of zones with different linear density leads to zones with different strength, durability, tensile resistance, and air permeability, in addition to different stretchability and/or elasticity.

In one embodiment, the first zone may be located at a vamp area of the shoe upper and may comprise yarns of linear density of 150 denier, and the second zone may be located at a heel area of the shoe upper and may comprises yarns of linear density of 300 denier. The heel area must resist a greater stress than the vamp area. On the other hand, the vamp area must have a greater breathability than the heel area. Therefore, the combination of zones with different linear mass density is beneficial.

The first zone and the second zone may differ in the thread counts of the woven structure thereof. Using more threads leads to a thicker and stiffer woven element, which may be beneficial if more support in a specific zone of the shoe upper is desired.

The present disclosure also relates to a shoe comprising an upper as described herein and a sole attached to the upper.

The present disclosure also relates to a method of manufacturing an upper for a shoe, comprising: weaving a woven element comprising at least one single-layer portion and at least one multi-layer portion in a single weaving process, wherein the single-layer portion is formed from a single woven layer and the multi-layer portion is formed from at least two overlapping woven layers, wherein the single-layer portion is adjacent to the multi-layer portion, and wherein the multi-layer portion comprises at least one protrusion of the woven element.

The advantages of such an upper have been described above and will not be repeated here for reasons of brevity.

The method of manufacturing an upper may further comprise the step of weaving the woven element into essentially a shape of the shoe upper. In particular, the woven element is woven into a one-piece and two-dimensional shoe upper, which is used in subsequent manufacturing to produce a shoe or footwear product.

The method of manufacturing an upper may further comprise the step: arranging filling material between the at least two overlapping woven layers of the multi-layer portion. The step of arranging the filling material may comprise weaving the filling material between the at least two overlapping woven layers while weaving the woven element.

The filling material between the at least two overlapping woven layers may be broken into sections or yarn scraps by mechanical or chemical techniques after weaving the woven element.

The step of arranging the filling material between the at least two overlapping woven layers may be performed after weaving the woven element.

The filling material may be yarns comprising polyester yarns and/or TPU yarns. Alternatively, the filling material may be recycled yarns, polypropylene yarns, wool yarns, TPE shock absorbing yarns or any suitable material to achieve different functional and aesthetical demands.

The method of manufacturing an upper may further comprise the step: weaving the woven element such that the at least one protrusion of the woven element protrudes from an outer surface of the woven element and/or from an inner surface of the woven element.

In one embodiment, a gap between the at least two overlapping woven layers of the multi-layer portion may be from about 1 mm to about 12 mm. Preferably, the gap may be from about 2 to 6 mm, in particular, about 2 to 4 mm.

The method of manufacturing an upper may further comprise the step: weaving the woven element such that the at least one protrusion comprises a shape of a straight stripe, a curved stripe, or a closed shape.

The at least one protrusion may comprise a closed shape which has an outer perimeter adjacent to a first single-layer portion and an inner perimeter adjacent to a second single-layer portion.

The method of manufacturing an upper may further comprise the step: arranging the multi-layer portion in at least one of a toe area, a vamp area, a midfoot area, a tongue area, and a heel area of the shoe upper.

The method of manufacturing an upper may further comprise the step: weaving the woven element such that at least two multi-layer portions are formed which are not connected to each other.

The method of manufacturing an upper may further comprise the step: weaving the woven element such that a plurality of protrusions are formed, wherein the size of the protrusions increases from the toe area to the heel area of the shoe upper.

The method of manufacturing an upper may further comprise the step: weaving the woven element such that a plurality of protrusions are formed, wherein a protrusion closest to the heel area comprises a largest size.

The method of manufacturing an upper may further comprise the step: weaving the woven element in a single weaving process to form a first zone and a second zone of the woven element, the first zone and the second zone differing in at least the yarns used therein and/or the woven structures thereof.

The method of manufacturing an upper may further comprise the step: weaving the woven element with polyester yarns and/or TPU yarns and/or nylon yarn, wherein the first zone and the second zone differ in yarn compositions thereof.

The first zone and the second zone may differ in the linear density of the yarns used therein and/or the thread counts of the woven structure thereof.

The method of manufacturing an upper may further comprise the step: heat-pressing the woven element at one or more preselected areas. Heat pressing is faster than sealing. Therefore, the manufacturing time can be reduced. Furthermore, heat pressing may create a stiffer property and an abrasion resistance surface of the woven element, which can also provide longer endurance for the shoe.

The one or more preselected areas may be located at the single-layer portion of the woven element.

The present disclosure also relates to a method of manufacturing a shoe comprising: manufacturing an upper for a shoe as described herein and attaching a sole to the shoe upper.

Another aspect of the present disclosure relates to an upper for a shoe, comprising: a one-piece woven element comprising: a first zone located in a heel area, a second zone located in a midfoot area, and a third zone located at a forefoot area, wherein the zones comprise different woven properties.

The manufacturing of the woven element in one piece avoids seams that can lead to injuries during sports activities. The combination of different woven zones with different properties leads to a beneficial adjustment of the respective zones of a shoe to desired requirements. The different woven properties may be yarn composition and/or woven structure.

At least one of the zones may comprise at least two subzones with different woven properties. The additional subzones may increase the number of possible applications, so the shoe may provide desirable functions and fulfill various demands for different sports.

At least one of the zones and/or subzones may comprise different weft yarns from other zones and/or subzones. The different weft yarns may differ in their yarn compositions, linear densities, and/or number of threads. In one embodiment, the first zone may comprise a higher linear density and/or a higher number of threads compared to the second and the third zones. In particular, in the heel area a reinforcement is advantageous to support the athlete in an optimal way, which may be achieved by the use of yarns of higher linear density and/or higher number of threads.

At least one of the zones and/or subzones may comprise a different woven structure from other zones and/or subzones. The woven structure may comprise a woven pattern and/or an orientation of a woven pattern. Different woven patterns lead to different mechanical properties. The usage of different orientations of the woven structure may achieve an improved alignment of required stretchability and/or elasticity in different areas of the shoe upper.

The second zone located in a midfoot area of the shoe upper may comprise a flat woven structure. A flat woven material has a smoother surface and is therefore more repellent to dirt particles. In addition, the soft surface provides improved wearing comfort.

The third zone located in a vamp area may be partly covered by a foil. The usage of a foil provides further reinforcement of the covered area and increases the water resistance of the shoe.

The third zone may further comprise a perforated lining. On the one hand, a lining provides a better heat accumulation. On the other hand, the perforations ensure a better breathability and the removal of moisture.

The present disclosure also relates to a shoe comprising an upper as described herein and a sole attached to the upper.

BRIEF DESCRIPTION OF THE FIGURES

In the following, exemplary embodiments of the invention are described with reference to the figures.

DETAILED DESCRIPTION

Possible embodiments of the present disclosure will be described in the following detailed description primarily with reference to a shoe. It is emphasized that the present disclosure is not limited by these embodiments.

Figure 1:
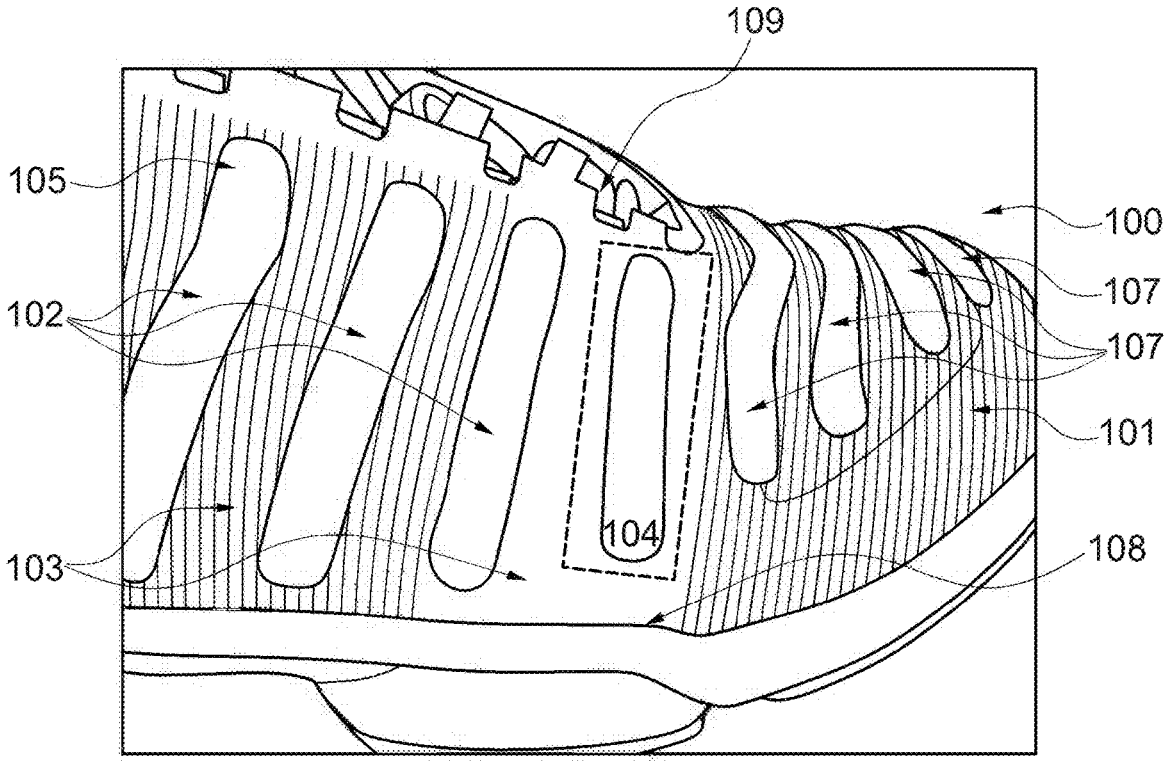
FIG. 1 shows a side view of a shoe according to some embodiments.

FIG. 1 shows an embodiment of an upper 101 of a shoe 100 according to the present disclosure. The upper 101 comprises a woven single-layer portion 103, which is formed from a single woven layer and essentially corresponds to the shape of the upper 101. The upper 101 further comprises a woven multi-layer portion 105, which is formed from two overlapping woven layers. In other embodiments, the woven multi-layer portion 105 can be formed by more than two woven layers. This configuration leads to stable protrusions 102 in a shape of essentially straight stripes 104. The woven single-layer portion 103 comprises a yarn composition of nylon, polyester, and TPU yarns. The woven multi-layer portion 105 comprises TPU yarns.

The upper 101 comprises a plurality of protrusions 102, 107, in general corresponding to the multi-layer portions 105, arranged at the midfoot area, vamp area, and the toe area of the shoe. The dimensions of the protrusions 102 at the midfoot area decrease along a direction from the heal area to the toe area. The four protrusions 107 at the toe area have a slight curvature corresponding to the curvature of the shape of the toe area. In other embodiments the protrusions 102 can be applied in the heel area and/or the instep area of the upper.

The single-layer portion 103 has a flat outer surface facing outward of the shoe. The protrusions 102 protrude from a surface corresponding to the outer surface of the adjacent single-layer portion 103. A gap between the two overlapping layers of the multi-layer portion 105 is from about 1 mm to about 12 mm, which can be understood as the height of the protrusion 102. In some embodiments, the protrusions 102, 107 arranged at the midfoot and toe areas have a height of about 2-6 mm, preferably roughly 4 mm. It is preferred that the protrusions 102, 107 are made of TPU yarns, which can increase abrasion and strengthen the durability of the shoe at these locations.

The protrusions 102 and 107 shown in FIG. 1 comprise a closed perimeter which is not connected to an edge of the shoe upper. The edge of the shoe upper may be referred to as an edge 108 between the upper and the sole or an edge 109 of the upper next to the tongue area. The protrusions 102, 107 accordingly form closed pockets, each of which has a closed internal space.

In other embodiments, the protrusion may have an open perimeter which ends at the edge 108, 109 of the shoe upper. This type of protrusion accordingly forms an open pocket of the shoe upper, which has an open internal space. For example, the two ends of the perimeter of one protrusion 102 at the midfoot area may both end at the edge 108 of the upper next to the sole. Therefore, the protrusion 102 may form an open pocket, similar to an open channel, which has an opening at the edge 108.

In the exemplary embodiment of FIG. 1, the closed pockets 102, 107 are filled with polyester yarns, preferably recycled polyester yarns. The polyester yarns can be filled into the internal space of the close pockets by injection through the voids formed between the weft and warp yarns of the woven element, which is a post-production procedure and is performed after manufacturing of the woven shoe upper. In other embodiments where the protrusions are open pockets, a filling material such as filling yarns can be added in the pocket via the opening of the pocket, followed by sealing or sewing the opening of the pockets. Therefore, the manufacturing procedure to provide filling material in the open pockets might be easier and more convenient. In some embodiments the filling yarns comprise TPU yarns, polyester yarns, or a mixture of polyester and TPU yarns.

Alternatively, the filling yarns may be chosen according to different demands for functions, e.g. hydrophobic, hollow fiber, natural fiber, graphene fibers, strain rate depending yarns, foamed yarns, foams without adhesives, etc. The filling material provides a cushioning effect at the protrusion and the corresponding multi-layer portion of the woven element such that the protrusions are still deformable.

Figure 2:
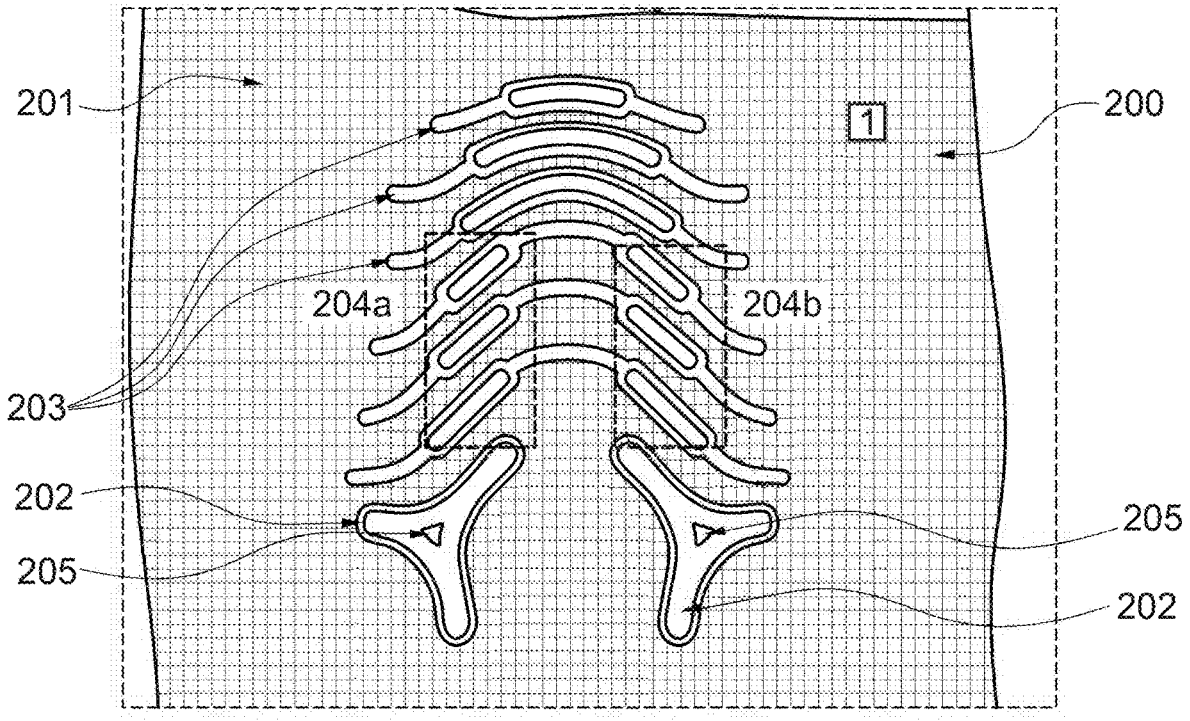
FIG. 2 shows a woven element of an upper of a shoe according to some embodiments.

FIG. 2 shows a woven element of an upper 200 according to the present disclosure. The woven element comprises a woven single-layer portion 201 and a plurality of woven multi-layer portions 202, 203, 204*a*, and 204*b*. The woven element comprises a composition of 73% of nylon monofilament yarn, 1% of polyester yarn and 26% of TPU yarn at both the single-layer portion 201 and the multi-layer portions. In other words, the single woven layer of the single-layer portion 201 and the at least two overlapping woven layers of the multi-layer portions have the same composition and woven structure. Alternatively, the single-layer portion and the multi-layer portions may compromise different compositions. For example, the multi-layer portions may be formed completely with TPU yarns.

The woven multi-layer portions 202, 203, 204*a*, and 204*b* comprise protrusions formed as closed pockets, which are filled with polyester yarns. In alternative embodiments, all or some of the protrusions can be formed as open pockets or open channels.

The two protrusions 202 comprise a three-pointed star shape and are located in a heel area of the upper 201 and a corresponding shoe after manufacture. The three-pointed star shape is a closed shape and has an outer perimeter adjacent to a first single-layer portion 201 and an inner perimeter adjacent to a second single-layer portion 205. The protrusions 204*a* and 204*b* are respectively located at the lateral and medial sides of a midfoot area of the upper 201 and comprise a shape of straight stripe. The three protrusions 203 located at the vamp area comprise a shape of curved stripe and varied dimensions decreasing in the direction toward the toe.

Figure 3:
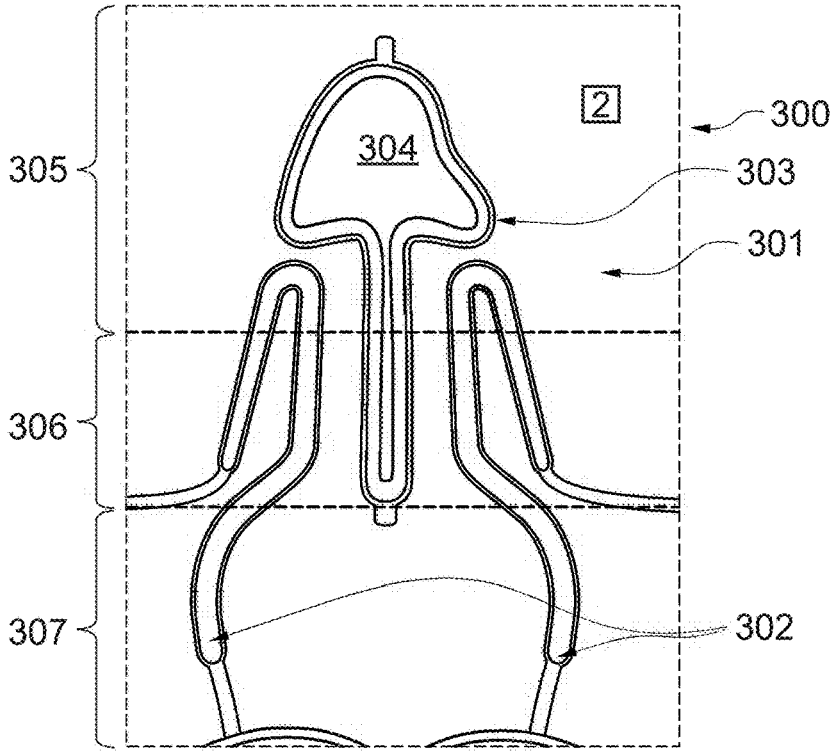
FIG. 3 shows a woven element of an upper of a shoe according to some embodiments.

FIG. 3 shows a woven element of an upper 300 according to the present disclosure. The woven element comprises a woven single-layer portion 301 and a plurality of woven multi-layer portions 302 and 303.

The woven multi-layer portions 302, 303 comprise protrusions formed as closed pockets. The protrusions 302 extend from a heel area respectively to the medial side and lateral side of the upper 300. It can be seen that the protrusions 302 have a closed shape like a curve located at the heel and midfoot areas of the upper 300. The protrusion 303 extends from an instep area to a vamp area of the upper and has a closed shape as an arrowhead. Similarly, the protrusion 303 has an outer perimeter adjacent to a first single-layer portion 301 and an inner perimeter adjacent to a second single-layer portion 304.

The first and second single-layer portions 301, 304 may have the same yarn composition or woven structure. For example, the single-layer portions 301, 304 may have a yarn composition of 24% of nylon monofilament yarn, 25% polyester yarn, and 51% TPU monofilament yarn. Another example is a yarn composition of 44% nylon monofilament yarn, 29% of polyester yarn, and 27% of TPU monofilament yarn.

Alternatively, the first and second single-layer portions 301, 304 may have different yarn compositions or woven structures. For example, the second single-layer portion 304 may be made of yarns with a higher linear density or with a higher number of threads than the yarns in the first single-layer portion 301.

Optionally, the single-layer portion 301 of the woven element may comprise zones 305, 306, and 307, which differ in their yarn compositions to provide different characteristics and performance functions, such as preferred abrasion, stretchability, and tear strength, at different areas of the shoe. The zone 305 essentially corresponds to the toe area and the vamp area; the zone 306 corresponds to the instep area and the midfoot area; while the zone 307 corresponds to mainly the heel area. Different yarns such as high abrasion polyurethane (PU) yarns, polyethylene HDPE yarns, polyamide (PA) yarns, high tenacity PA yarns, polyester (PES), elastomer yarns, and twisted yarns can be used in the different zones to achieve an optimal functional performance.

Figure 4A:
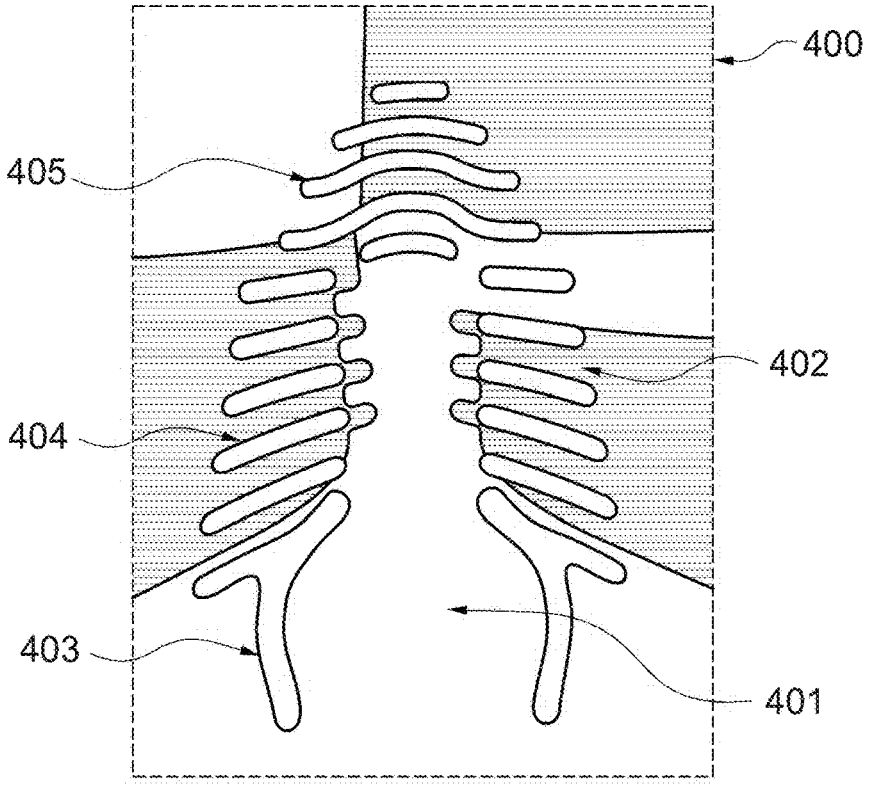
FIG. 4A shows a woven element of an upper of a shoe according to some embodiments.
Figure 4B:
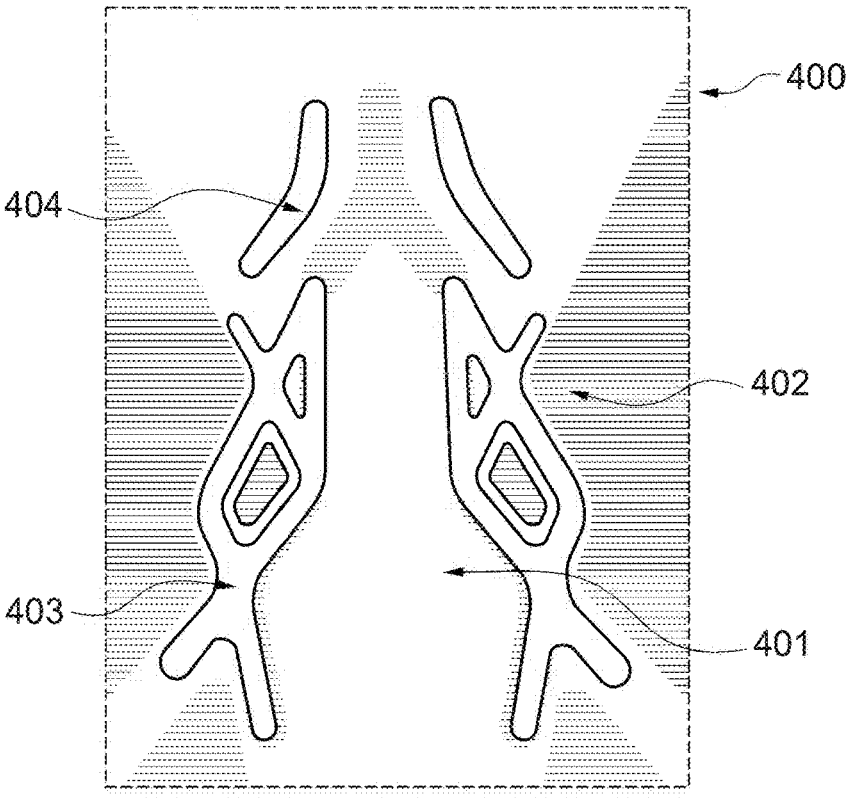
FIG. 4B shows a woven element of an upper of a shoe according to some embodiments.

FIGS. 4A and 4B show further examples of woven elements of an upper 400 according to the present disclosure. The woven elements comprise a plurality of woven single-layer portions 401, 402, and a plurality of woven multi-layer portions 403, 404, and 405.

It can be seen that the woven single-layer portions 401, 402 have different woven structures, and there have different visual appearances and functional properties as well. The location, dimension, and shape of the single-layer portions 401, 402 can be different and adjusted to fulfill different requirements. For example, the distribution of the single-layer portions 401, 402 in FIGS. 4A and 4B are quite different. Optionally, the yarn composition of the single-layer portions 401, 402 can also be different. In the embodiments, transparent yarns are used in single-layer portion 402, essentially corresponding to the midfoot area of the shoe upper, to create a special visual effect and better breathability at these areas.

The plurality of the multi-layer portions 403, 404, 405 can have different dimensions, shapes, locations, amounts, and other properties. As described herein, the multi-layer portions form protrusions of the woven element, which can be optionally filled with filling material in the internal space thereof. Therefore, the protrusions 403, 404, and 405 can provide a cushioning effect and/or an improved abrasion function, and can be designed and arranged on preferred areas of the shoe. As shown in FIGS. 4A and 4B, it is preferred to arrange the protrusions at the forefoot area, midfoot area, and heel area of the shoe upper, particularly the vamp area and the middle of the midfoot area.

Figure 5:
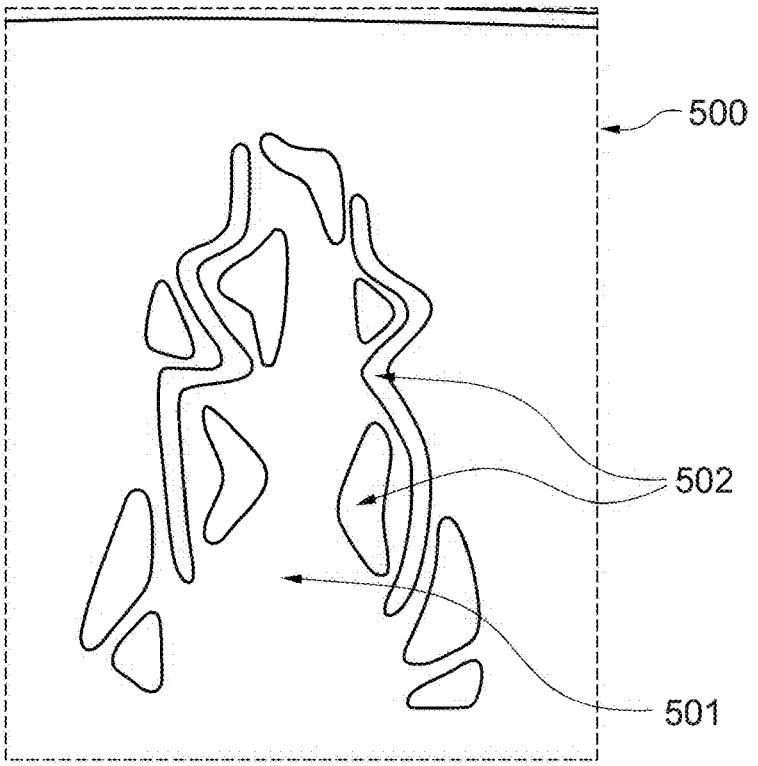
FIG. 5 shows a woven element of an upper of a shoe according to some embodiments.

FIG. 5 shows a woven element of an upper 500 according to the present disclosure. The woven element 500 comprises a woven single-layer portion 501 and a plurality of woven multi-layer portions 502. In this embodiment, the woven element comprises a jacquard woven fabric with a composition of TPU yarns, polyester yarns, and monofilament yarns. The monofilament yarns are single filaments of synthetic polymer that are strong and used in a fabric without being twisted with other filaments into a yarn. In this embodiment, the monofilament yarns may be TPU monofilament yarns and/or thermoplastic polyester elastomer (TPEE) yarns, which especially may provide high strength and desired transparent visual effect at the same time. Alternatively, the monofilament yarns may also be made of nylon, glass fiber, or other suitable materials.

Similar to other embodiments shown above, the multi-layer portions 502 form a plurality of the protrusions and closed pockets, which are arranged in different areas of the shoe upper. The use of TPU yarns on the woven element, especially at the protrusions 502, can increase the abrasion resistance on the outer surface of the shoe upper, while also providing good comfort to the wearer on the inside of the upper.

The protrusions 502 are filled with filling materials, for example, virgin polyester yarns, woven fabric scrap, recycled polyester yarns, or recycled woven fabric scrap. It is preferred that the filling yarns are in a continuous form, instead of broken pieces of short yarns. In this embodiment, the protrusions form closed pockets and therefore are filled with the filling material by a thin needle injection, with manual pedal speed control. The height or thickness of the protrusions can vary from about 2 to 8 mm, with a manufacturing tolerance of 15%-20%.

Figure 6A:
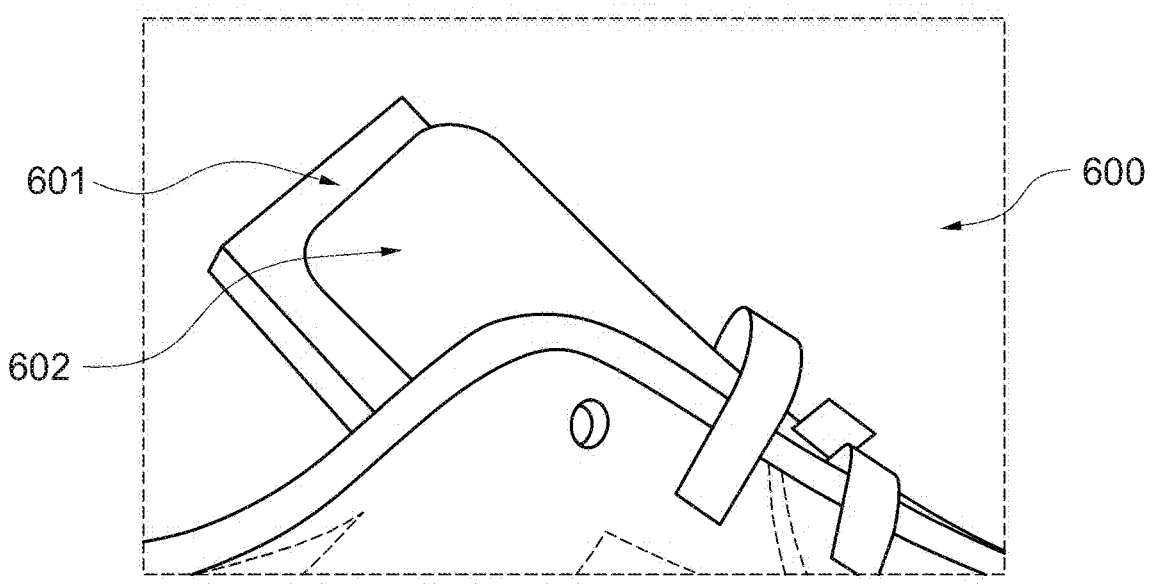
FIG. 6A shows a woven element of an upper of a shoe according to some embodiments.

FIG. 6A shows a woven element of a shoe upper 600 according to some embodiments of the present disclosure. The woven element 600 comprises a woven single-layer portion 601 and a woven multi-layer portion 602 adjacent to the single-layer portion 601. The woven multi-layer portion 602 forms a protrusion and a closed pocket located at the tongue area of the shoe upper. The closed pocket is preferably filled with filling material to increase the thickness of the woven element and thus provide an optimized cushioning effect at the tongue area. The dimension of the protrusion can be adjusted depending on the specific demands. In other embodiments, the woven element can also have several multi-layer portions 602 located at the tongue area, each separate from each other.

Figure 6B:
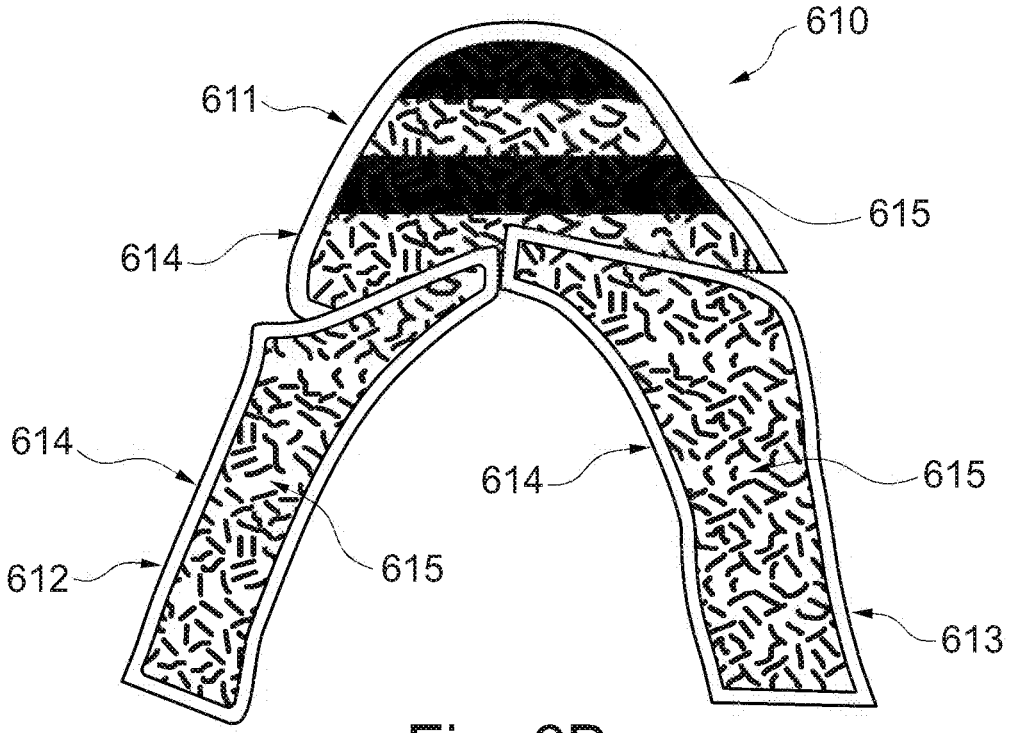
FIG. 6B shows a woven element of an upper of a shoe according to some embodiments.

FIG. 6B shows another woven element of a shoe upper 610 according to some embodiments of the present disclosure. The woven element comprises three pieces 611, 612, and 613, respectively corresponding to the forefoot area of the shoe upper and the lateral and medial midfoot areas of the shoe upper. Each of the three pieces 611, 612, and 613 is formed by a woven multi-layer portion 615 surrounded by a corresponding single-layer portion 614. The woven multi-layer portions 615 preferably comprise 55-65% TPU monofilament yarns and 35-45% polyester yarns, which may provide high strength, in addition to good feel and comfort for a shoe wearer. Optionally, the woven multi-layer portions 615 may be filled with filling materials, for example, polyester woven fabric waste scrap. The woven single-layer portions 614 comprise TPU monofilament yarns.

The three pieces 611, 612, and 613 of the woven element may be combined with each other and accordingly form at least the main portion of the shoe upper. In this way, a shoe upper may be made with the three woven pieces 611, 612, and 613 and optimally with merely minor additional elements, which simplifies the manufacturing procedure for the shoe upper. For example, it helps to create less complex woven textiles, reducing weaving/printing time, and replacing it with injection filling that is applied with more raw material. In addition, the filled or padded pieces can provide comfort to a greater coverage of a wearer's foot.

Figure 7:
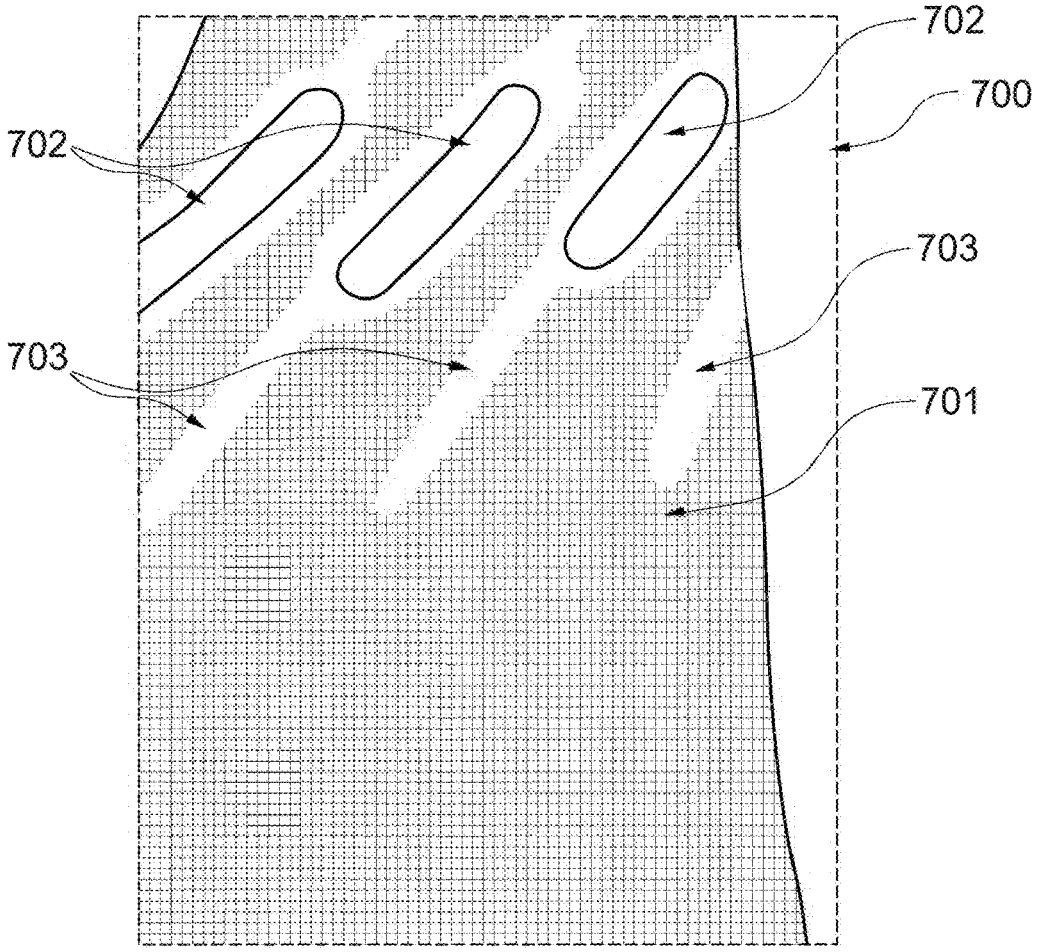
FIG. 7 shows a woven element of an upper of a shoe according to some embodiments.

FIG. 7 shows a woven element 700 of an upper according to some embodiments of the present disclosure. The woven element 700 comprises a woven single-layer portion 701 and a plurality of woven multi-layer portions 702. This embodiment differs from other previously described embodiments in that the woven element further comprises preselected areas 703 that are heat-pressed. Preferably, the heat-pressed areas 703 are at the single-layer portion 701 of the woven element 700. In particular, the heat-pressed areas 703 are adjacent to the multi-layer portions 702, as shown in FIG. 7.

The woven element 700 is made of TPU monofilament yarns, in both the single-layer portion 701 and the multi-layer portions 702. TPU yarns in general have a melting point of approximately 180-190 degrees Celsius. Heat-pressing the preselected areas 703 is to achieve the purpose to hot-melt the TPU yarns, and therefore create different functional properties of the woven element at these preselected areas 703. The TPU yarns at the preselected areas 703 can be either partially or completely hot-melted. When they are merely partially melted, the woven element at the preselected areas 703 still retains the woven fabric structure. When they are completely melted, the TPU yarns merge into a continuous TPU film which provides a higher stiffness and better abrasion resistance at the preselected areas 703, therefore increasing the endurance of the shoe upper.

The woven multi-layer portions 702 form a plurality of closed pockets which are filled with polyester yarns. Optionally, other preselected areas at the multi-layer portions 702 can also be hot-melted to form a stiffer surface with a higher abrasion resistance thereon. As polyester yarns in general have a higher melting temperature than TPU yarns, it is preferred to perform the heat-pressing at a temperature higher than the melting point of TPU yarns but lower than the melting point of the filling polyester yarns, such that the polyester yarns remain unmelted and accordingly flexible. In this way, the closed pockets of the woven element 700 have stiff outer and inner surfaces with a softer and movable filling material in between, which provides an optimized cushioning effect.

In other embodiments, the filling material can also comprise TPU yarns or other material with lower meting points. Therefore, when heat-pressing the multi-layer portions at a preselected temperature, both the overlapping woven layers of the multi-layer portions and the filling material therein can be partially or completely hot-melted. The functional properties and characteristics of the woven element can thus be designed and adjusted in different portions and areas of the woven element. For example, one woven element can have different hardness and/or stiffness at different areas.

The embodiments of the woven element of a shoe upper according to the present disclosure mentioned herein are preferably manufactured by weaving the at least one single-layer portion and the at least one multi-layer portion in a single weaving process. In other words, the woven element of the shoe upper is preferably a one-piece woven fabric, in which the single-layer portion is formed from a single woven layer and the multi-layer portion is formed from at least two overlapping woven layers. The multi-layer portion is woven to be adjacent to the single-layer portion. In addition, the multi-layer portion is woven to comprise at least one protrusion of the woven element. The manufacture of the woven element of a shoe upper is accordingly simplified with a higher efficiency, which brings the possibility to manufacture protrusions, i.e, 3D structures, on a shoe upper in a single manufacturing procedure. In particular, the woven element is woven into essentially a shape of the shoe upper.

The manufacture of the woven element can further comprise arranging filling material between the at least two overlapping woven layers of the multi-layer portion, i.e., filling the filling material in the protrusions or pockets formed by the multi-layer portion. The filling material can be filled in the multi-layer portion after weaving the one-piece woven element, e.g., by injection techniques. Alternatively, the filling material can be woven together with the woven element during the single weaving process.

Figure 8:
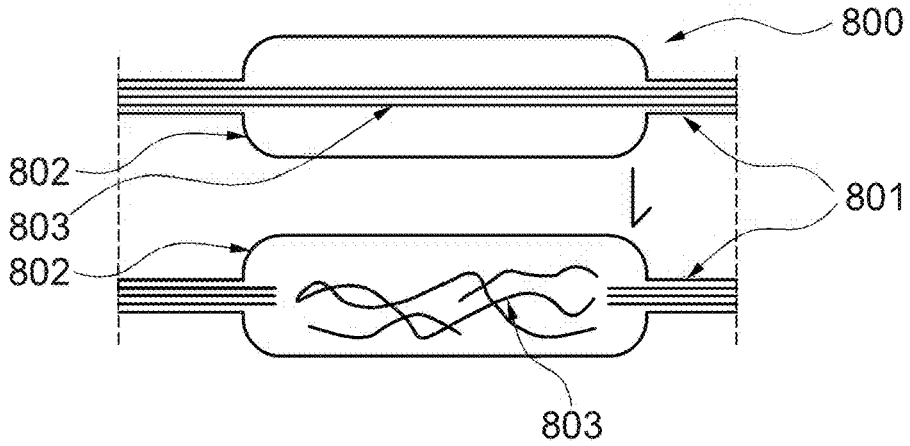
FIG. 8 shows a schematic diagram showing a cross-sectional view of a woven element of an upper of a shoe according to some embodiments.

FIG. 8 is a schematic diagram showing a cross-sectional view of a woven element 800 of an upper according to some embodiments of the present disclosure. The woven element 800 comprises a woven single-layer portion 801 and a woven multi-layer portion 802. In this embodiment, the filling material 803 includes yarns that are woven together with the woven element 800 and are floating in the multi-layer portion 802. In other words, the woven element 800, including the single-layer portion 801, the multi-layer portion 802, and the filling material 803, are completely manufactured together after the single weaving process. The filling material 803 can be optionally broken into sections or yarn scraps by mechanical or chemical techniques as an additional manufacturing step after the single weaving process. Optionally, the yarns used in the woven element may have different colors to present a preferred aesthetic appearance of the shoe upper.

Figure 9:
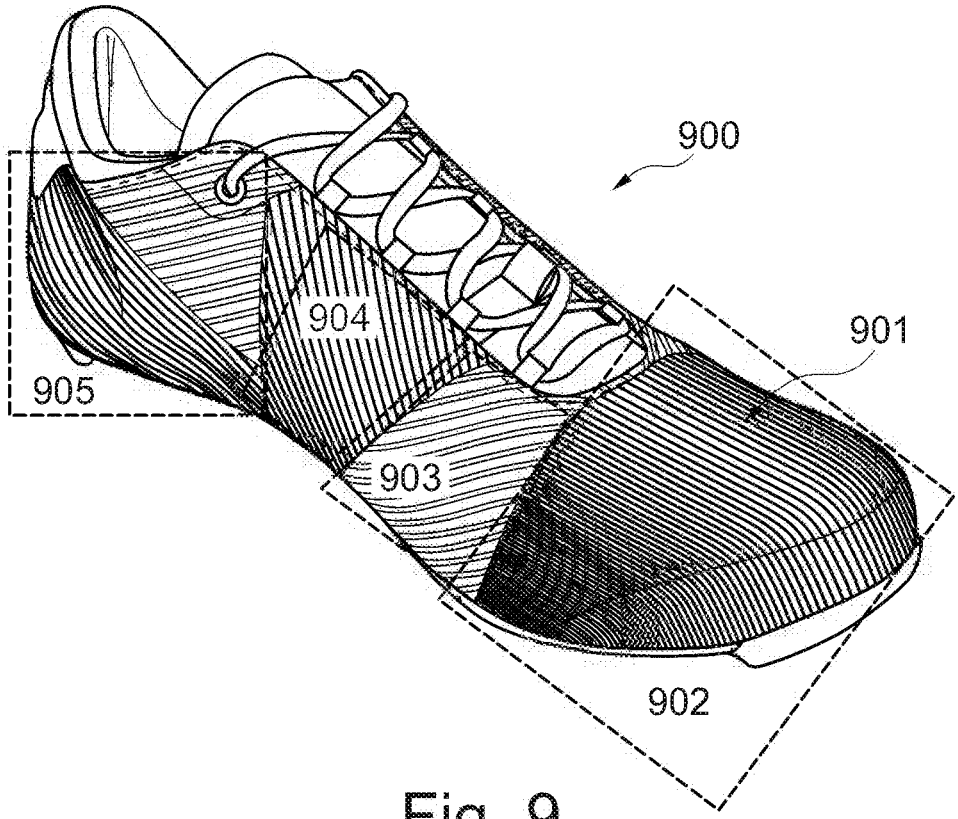
FIG. 9 shows a cycling shoe according to some embodiments.

FIG. 9 shows an embodiment of the present disclosure, namely a one-piece engineered woven shoe upper 901 of a sports shoe 900, particularly a cycling shoe. The woven shoe upper 901 comprises three zones respectively located at the forefoot area 902, the midfoot areas 903 and 904, and the heel area 905. The woven zones have different properties such as different yarn composition and/or woven structure, in order to provide different functional requirements at the different areas. For example, it is preferred to have higher stiffness, strength, and stability at the heel area 905 of a shoe, which can be achieved by a thicker woven element. On the other hand, at the forefoot area 902 a softer, more flexible, and more comfortable fabric is desired for a shoe wearer, which can be provided by a thinner woven element with higher breathability.

In this embodiment, the different zones comprise different yarn composition, e.g., with different linear densities, and optionally different woven structures. In particular, only the weft yarns of each zone are different, which run from a medial side to a lateral side of the shoe upper 901. The warp yarns used in the various zones are the same, which runs from the toe area to the heel area of the shoe upper 901 and have a linear density of, for example, 150 denier.

In the forefoot area 902, the weft yarns have a linear density of 150 denier.

In the midfoot areas 903, 904 and the heel area 905, the weft yarns have a linear density of 300 denier. However, the woven structures of the zones 904 and 905 differ in their woven pattern, while the zones 903 and 905 comprise essentially the same woven pattern but with different orientations.

The zones 903 and 904 have a flat woven structure on both the top side (outer surface) and a back side (inner surface) of the shoe upper 901. At the back side (inner surface) of the shoe upper 901, the weft yarns at the zone 904 are partially floating on the surface, creating a softer feel and additional comfort to the feet of a wearer. Zone 904 is particularly located at the side of the shoe's eyestay.

In the heel area 905 and the midfoot areas 903, 904, the same yarns with linear density of 300 denier are used in the weft yarns, but the thread count in the zone 1005 (shown in FIG. 10) is more than the thread count in zones 903, 904. For example, twice of the amount of the weft yarns is used in a same square area of the woven element in the zone 905. This results in a thicker and stiffer woven element in the zone 905 at the heel area, which accordingly provides more support at the heel of a wearer.

Optionally, the yarns used in the various zones may have different color to present a preferred aesthetic appearance of the shoe upper.

In addition, when the shoe upper 901 is used to manufacture a shoe, an additional heel counter together with paddings may be added at the inside of the heel area 905 of the shoe upper 901 to further provide support and comfort for a wearer.

Optionally, a foil can be added to the shoe upper 901 at the toe box area to reinforce the toe box of the shoe upper while at the same time keeping the comfort and breathability at the forefoot area 902 of the shoe upper. Also, a perforated lining or reinforcement can be added at the inside surface of the forefoot area.

Figure 10:
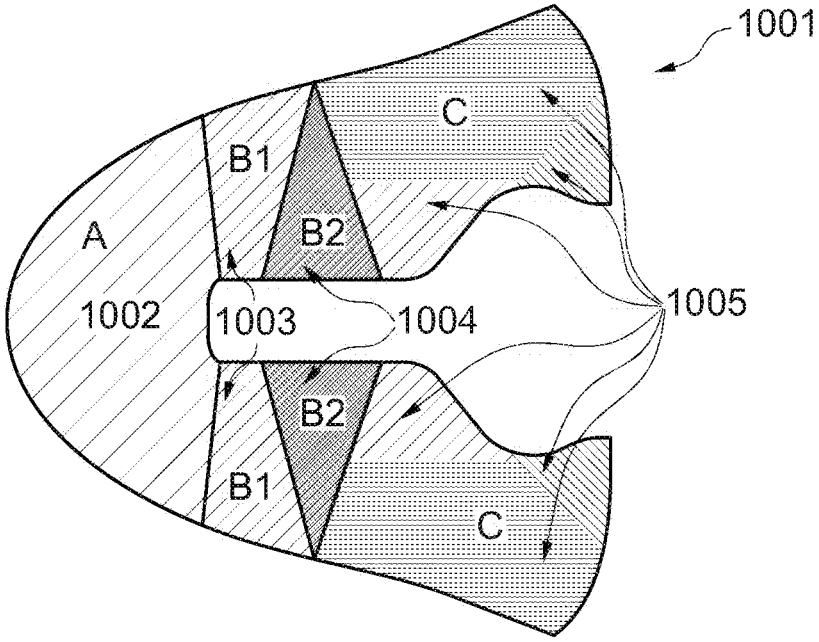
FIG. 10 shows a graphical illustration of an upper of a cycling shoe according to some embodiments.

FIG. 10 shows a graphical illustration of the other aspects of the present disclosure. An upper 1001 comprises the zones 1002, 1003, 1004 and 1005. The zone 1002 is located at the forefoot area and is a plain weave having uniform structure. The zones 1003, 1004 are located at the midfoot area and are different at their orientations of the woven structure. The zone 1005 is located at the heel area and comprise three portions or subzones with different yarn directions.

In the following, embodiments of the present disclosure relating to an upper with a specific woven structure are described.

In a first example, an upper for a shoe includes a single woven piece having a first zone located in a heel area, a second zone located in a midfoot area, and a third zone located in a forefoot area, wherein the zones comprise different woven properties.

In a second example, the upper includes the features according to example 1, and at least one of the zones includes at least two subzones with different yarn composition and/or woven structure.

In a third example, the upper includes the features according to one of examples 1-2, and the weft yarns in at least two of the zones and/or subzones differ in their linear densities and/or number of threads per unit area.

In a fourth example, the upper includes the features according to one of examples 1-3, and at least one of the zones and/or subzones differ in their woven structures, and/or yarn composition, and/or yarn properties.

In a fifth example, the upper includes the features according to one of examples 1-4, and the first zone includes yarns with a higher linear density and/or a higher number of threads per unit area than the yarns in at least one of the other zones.

In a sixth example, the upper includes the features according to example 4, and the woven structure includes a woven pattern and/or an orientation of a woven pattern.

In a seventh example, the upper includes the features according to one of examples 1-6, and the second zone includes a flat woven structure.

In an eighth example, the upper includes the features according to one of examples 1-7, and the third zone is partly covered by a foil and/or includes a perforated lining.

In a ninth example, a shoe includes a shoe upper according to one of examples 1-8 and a sole attached to the shoe upper.

What is claimed is:

1. An upper for a shoe, the upper comprising:

a woven element comprising:

at least one non-heat-pressed single-layer portion formed from a single woven layer, a first multi-layer portion formed from at least two overlapping woven layers, a second multi-layer portion formed from at least two overlapping woven layers, a first heat-pressed portion comprising melted yarn of the single-layer portion surrounding the first multi-layer portion, and a second heat-pressed portion comprising melted yarn of the single-layer portion surrounding the second multi-layer portion, wherein the at least one non-heat-pressed single-layer portion surrounds and is disposed between the first heat-pressed portion and the second heat-pressed portion, wherein the first and second multi-layer portions comprises at least one protrusion of the woven element, wherein gaps are formed between the at least two overlapping woven layers at the first and second multi-layer portions, and the gaps at the first and second multi-layer portions are filled with a filling material, wherein the filling material comprises a yarn that is woven into the single woven layer and extends into the gaps between the at least two overlapping woven layers such that the yarn floats within the gaps, and wherein the yarn of the filling material is melted into the first and second multi-layer portions within the gaps.

2. The upper according to claim 1, wherein the woven element comprises a shape corresponding to a shape of the upper.

3. The upper according to claim 1, wherein the woven element comprises an outer surface and an inner surface, and wherein the at least one protrusion of the woven element protrudes from the outer surface or from the inner surface.

4. The upper according to claim 1, wherein the at least one protrusion of the first or second multi-layer portions comprises a closed perimeter not connected to an edge of the upper.

5. The upper according to claim 1, wherein the at least one protrusion of the first or second multi-layer portions comprises a perimeter ending at an edge of the upper.

6. The upper according to claim 1, wherein the gaps between the at least two overlapping woven layers of the first and second multi-layer portions are from about 1 mm to about 12 mm.

7. The upper according to claim 1, wherein the at least one protrusion of the first or second multi-layer portions comprises a shape of a straight stripe, a curved stripe, or a closed shape.

8. The upper according to claim 7, wherein the at least one protrusion of the first or second multi-layer portions comprises a closed shape which has an outer perimeter adjacent to a first single-layer portion and an inner perimeter adjacent to a second single-layer portion.

9. The upper according to claim 1, wherein the at least one protrusion of the first or second multi-layer portions comprises a closed shape, and wherein the closed shape is a shape of a ring, an arrowhead, or a three-pointed star.

10. The upper according to claim 1, wherein the first or the second multi-layer portion is arranged in at least one of a toe area, a vamp area, a midfoot area, a tongue area, and a heel area of the upper.

11. The upper according to claim 1, wherein the first and second multi-layer portions are not connected to each other.

12. The upper according to claim 1, wherein the woven element comprises at least two protrusions which differ in at least their shape or dimension.

13. The upper according to claim 1, wherein the woven element comprises a plurality of protrusions, and wherein the size of the protrusions increases from a toe area to a heel area of the upper.

14. The upper according to claim 1, wherein the woven element comprises a plurality of protrusions, and wherein a protrusion closest to a heel area of the upper comprises a largest size.

15. The upper according to claim 1, wherein the woven element comprises a first zone and a second zone which differ in at least yarn composition or woven structure.

16. The upper according to claim 15, wherein the woven element comprises polyester yarns, TPU yarns, or nylon yarns, and wherein the first zone and the second zone differ in yarn composition.

17. The upper according to claim 16, wherein yarns of the first zone have a different linear density than yarns of the second zone.

18. The upper according to claim 17, wherein the first zone is at a forefoot area of the upper and comprises yarns of linear density of 150 denier, and the second zone is at a heel area of the upper and comprises yarns of linear density of 300 denier.

19. The upper according to claim 15, wherein a woven structure of the first zone has a different thread count than a woven structure of the second zone.

20. The upper according to claim 1, wherein the woven element is a one-piece woven fabric.

21. A shoe comprising:

a shoe upper according to claim 1; and a sole attached to the shoe upper.

22. The upper according to claim 1, wherein the yarn of the filling material that floats in the gaps is broken into a plurality of discontinuous pieces within the gaps.

23. An upper for a shoe, the upper comprising:

a woven element comprising:

at least one single-layer portion formed from a single woven layer and comprising a first yarn, and at least one multi-layer portion formed from at least two overlapping woven layers, wherein the multi-layer portion comprises at least one protrusion of the woven element, wherein the at least one single-layer portion is adjacent to the at least one multi-layer portion, wherein a gap is formed between the at least two overlapping woven layers and the gap is filled with a filling material, wherein the first yarn of the single woven layer extends into and terminates within the gap between the at least two overlapping woven layers such that the first yarn floats within the gap, wherein the filling material comprises a plurality of discontinuous pieces of the first yarn disposed within the gap, and wherein the plurality of discontinuous pieces of the first yarn of the filling material are discontinuous with the first yarn of the single woven layer.

* * * * *